US005129311A

United States Patent [19]

Hart

[11] Patent Number: 5,129,311

[45] Date of Patent: Jul. 14, 1992

[54] PISTON ASSEMBLY WITH PRIMARY AND CO-CENTRIC SECONDARY PORTIONS

[75] Inventor: R. Hart, Northolt, Great Britain

[73] Assignee: National-Oilwell (UK) Ltd., Scotland

[21] Appl. No.: 554,060

[22] Filed: Jul. 16, 1990

[30] Foreign Application Priority Data

Jul. 21, 1989 [GB] United Kingdom ..... 8916743

[51] Int. Cl.[5] ..... F01B 25/26; F01B 7/00

[52] U.S. Cl. ..... 92/5 R; 92/61; 92/62; 92/75; 92/107; 92/181 P; 91/189 R; 91/189 A; 91/401; 91/440

[58] Field of Search ..... 92/5 R, 61, 62, 75, 92/107, 128, 181 R, 181 P; 91/189 R, 189 A, 401, 440, 442, 443, 399, 31; 251/62, 63.5

[56] References Cited

U.S. PATENT DOCUMENTS

| | | | |
|---|---|---|---|
| 2,531,907 | 11/1950 | Daubenmeter et al. | 92/75 |
| 2,649,842 | 8/1953 | Caldwell et al. | 92/62 |
| 2,932,280 | 4/1960 | Vielmo | 91/442 |
| 3,149,541 | 9/1964 | Hutter et al. | 91/440 |
| 4,308,018 | 12/1981 | Nakamura et al. | 91/189 R |
| 4,337,687 | 7/1982 | Hoover | 91/401 |
| 4,445,424 | 5/1984 | Foster et al. | 92/5 R |
| 4,687,449 | 8/1987 | Fenrich | 91/399 |
| 4,706,781 | 11/1987 | Ikimi et al. | 91/399 |

FOREIGN PATENT DOCUMENTS

| | | | |
|---|---|---|---|
| 2304239 | 8/1973 | Fed. Rep. of Germany | 92/62 |
| 2315169 | 10/1974 | Fed. Rep. of Germany | 92/75 |
| 0579458 | 11/1977 | U.S.S.R. | 92/62 |
| 0681235 | 8/1979 | U.S.S.R. | 92/75 |

*Primary Examiner*—Thomas E. Denion

*Attorney, Agent, or Firm*—R. J. Bunyard; L. A. Fillnow; R. H. Johnson

[57] ABSTRACT

A piston assembly comprising a primary piston and a co-centric secondary piston. The pistons are received within a housing for reciprocating movement therein and relative to each other. The housing and the pistons are arranged for operating pressure to be applied to the secondary piston so as to drive both pistons within the housing. The secondary piston is provided with means enabling the operating pressure to be equalized across the secondary piston and at least one bypass passage extends through the secondary piston. The arrangement is such that upon completion of the stroke of the pistons pressure equalization occurs across the secondary piston which causes the pistons to separate. The bypass passage becomes fully operable subsequent to pressure equalization, whereby a fast return stroke is achieved.

21 Claims, 3 Drawing Sheets

PISTON ASSEMBLY WITH PRIMARY AND CO-CENTRIC SECONDARY PORTIONS

BACKGROUND OF THE INVENTION

1. Field of the Invention

The present invention relates to a piston assembly which finds particular but non-limiting application as a valve actuator.

2. Description of the Prior Art

In known piston assemblies a piston is caused to slide within a chamber by the supply of a pressurised operating fluid, on one side of the piston. Difficulties arise in dealing with the operating fluid upon the return stroke of the piston. The return stroke is often effected by means separate from the operating fluid. A feature often found in known arrangements is volume compensation. That is, operating fluid is provided on both sides of the piston and reciprocation of the piston within the chamber requires compensation, for the resulting change in volume occupied by the operating fluid on either side of the piston. Providing such a feature is relatively burdensome in the design and manufacture of the arrangement.

SUMMARY OF THE INVENTION

With a view to providing an improved arrangement, the Present invention provides a piston assembly comprising a primary piston and a co-centric secondary piston, both received for reciprocating movement within a piston housing, the pistons being capable of reciprocating movement relative to each other and being arranged within the housing for operating pressure to be applied to the secondary piston so as to drive both pistons within the housing, wherein the secondary piston is provided with means enabling the operating pressure to be equalised across the secondary piston and is provided with a by-pass passage therethrough, such that said by-pass passage becomes fully operable subsequent to said pressure equalisation.

BRIEF DESCRIPTION OF THE DRAWINGS

Embodiments of the present invention will now be described by way of example only and with reference to the accompanying drawings, in which.

DETAILED DESCRIPTION OF THE PREFERRED EMBODIMENTS

The piston assembly of the present invention will now be described with reference to the particular application of valve actuators. However, it is to be understood that the invention is not limited to use of the piston assembly in valve actuators.

Figure 1:
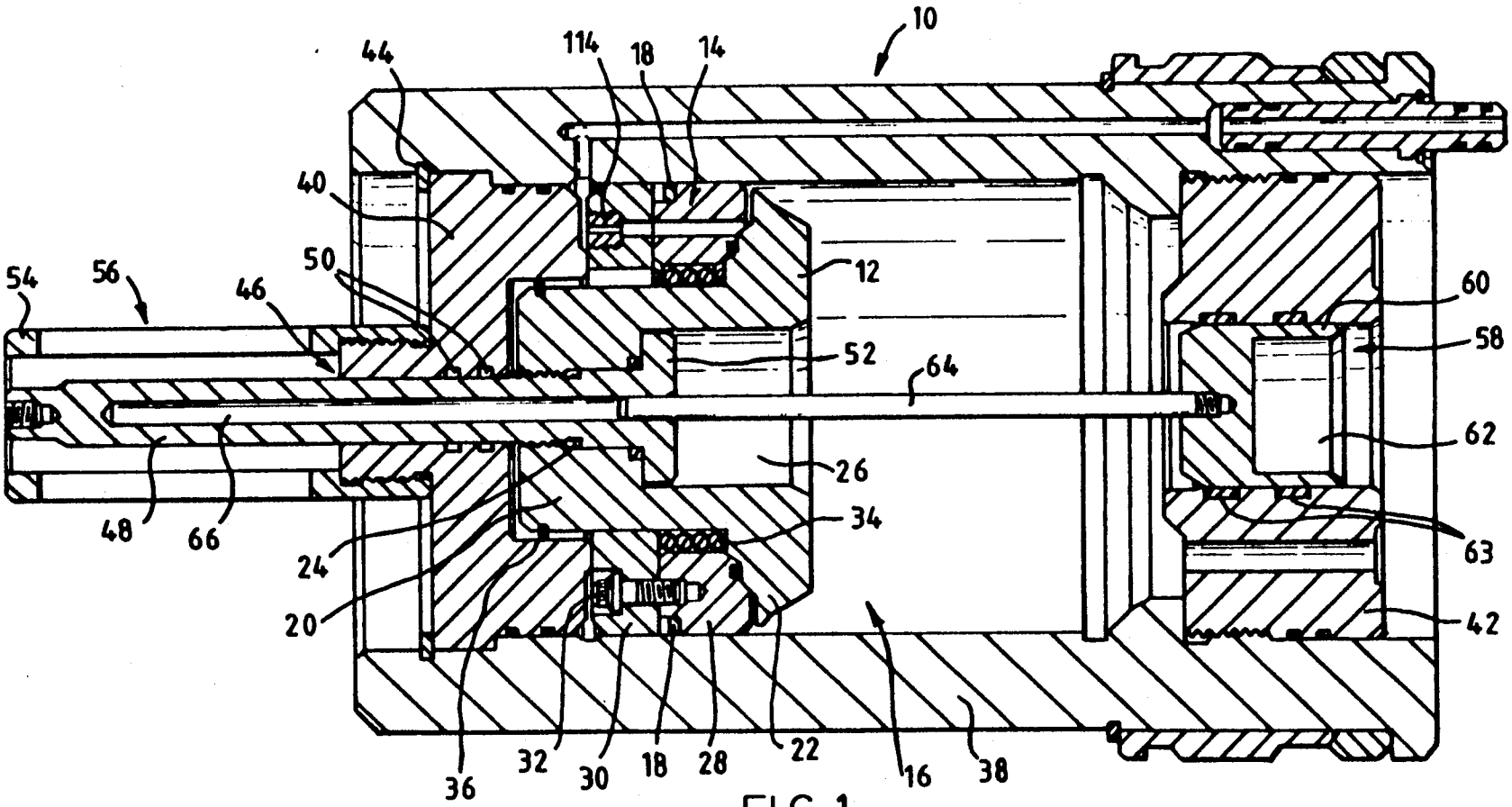
FIG. 1 is a schematic vertical section through a valve actuator including a piston assembly embodying the present invention, prior to installation of the actuator on a valve.
Figure 2:
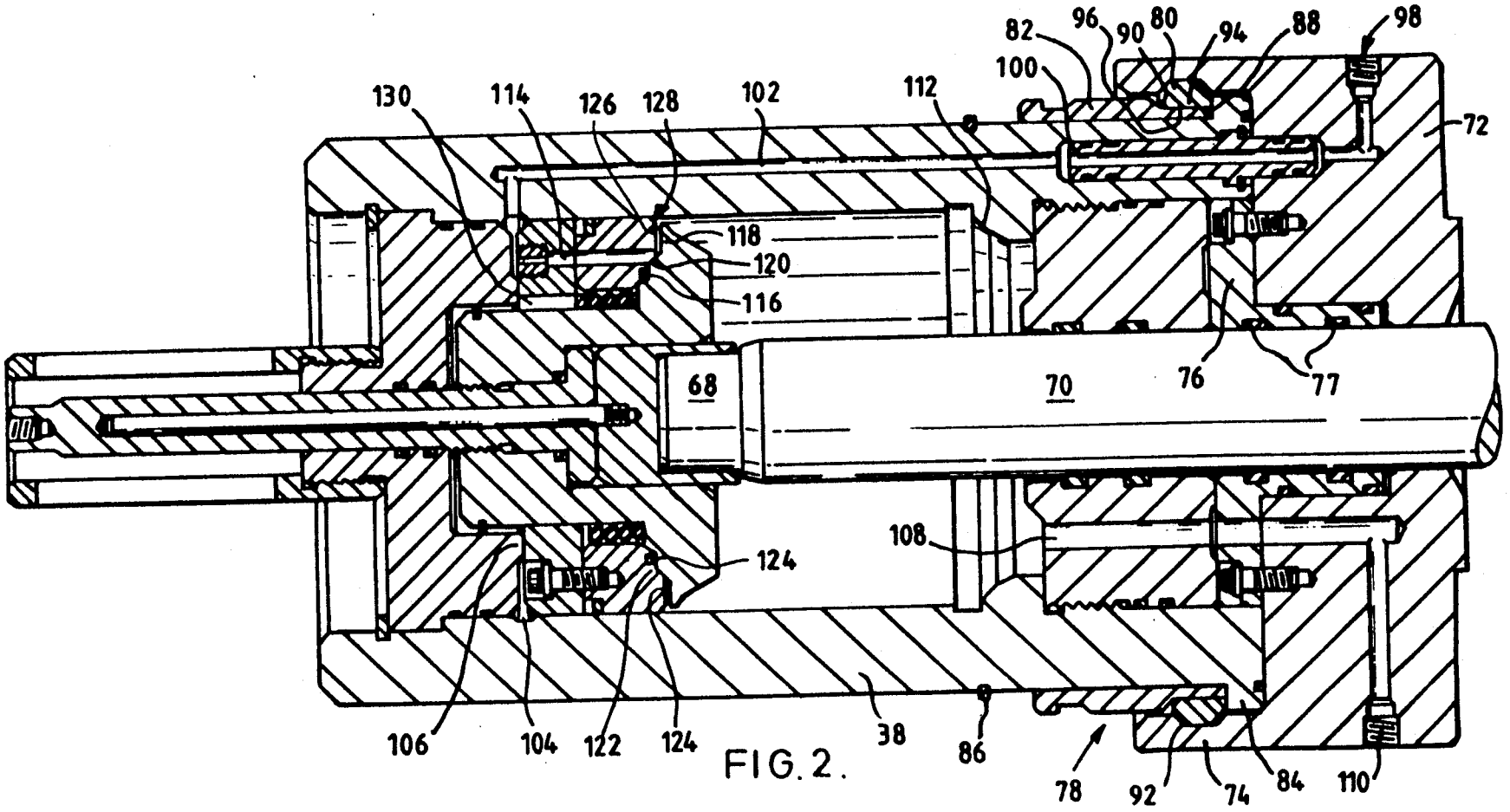
FIG. 2 is a partial vertical section similar to FIG. 1 showing the actuator of FIG. 1 when installed upon a valve.

With reference to FIGS. 1 and 2, the basic components are a piston housing 10, a primary piston 12 and a secondary piston 14. Housing 10 provides a chamber 16 within which the pistons 12 and 14 reciprocate. The pistons are co-centric, but only the secondary piston 14 is in sliding contact with the wall of the chamber 16. Piston 14 carries seals 18 which seal against the cylindrical wall of chamber 16, thus separating chamber 16 into two fluid receiving portions—one on either side of the pistons.

The primary piston 12 is in the form of a boss 20 with a flange-like head 22. A central bore 24 passes through the piston and has a portion 26 of enlarged diameter which is open to the face of the head 22.

As illustrated, the secondary piston 14 is formed of two components, an annular ring 28 and a baseplate 30. Ring 28 and baseplate 30 are secured together by means of bolts 32 (one of which is shown in FIGS. 1 and 2). Baseplate 30 has a central aperture which slidingly receives the boss 20 of the primary piston 12. The outer diameters of ring 28 and base plate 30 are essentially the same as the diameter of the cylindrical wall defining chamber 16. The seals 18 are held between ring 28 and baseplate 30. The internal diameter of ring 28 is sufficiently larger than the external diameter of boss 20 so as to accommodate a helical spring 34 therebetween. The forward or free face of ring 28 abuts against the rear face of head 22 of primary piston 12. The abutting faces of ring 28 and head 22 carry complimentary profiles, which will be described in more detail. Spring 34 acts to separate ring 28 from head 22. Rearward movement of piston 14 relative to piston 12 is mechanically limited by a circlip 36 carried adjacent the rearward end of boss 20.

Housing 10 comprises a cylindrical barrel 38, a top cap 40 and a bottom cap 42. Caps 40 and 42 seat on respective shoulders provided on the internal surface of barrel 38, cap 40 being held in position by a circlip 44 and cap 42 being threadedly engaged with barrel 38. Top cap 40 has a central aperture 46 through which passes a indicator rod 48, the rod being secured to primary piston 12. Seals 50 are provided to enable indicator rod 48 to slide within aperture 46 without leakage of fluid into or out of chamber 16. Indicator rod 48 has a enlarged head 52 which seats in the bottom of recess 26 of piston 12, with the shank of rod 48 being threadedly engaged in the narrower portion of the bore 24. Thus, indicator rod 48 provides an external visual indication of the location of piston 12 within chamber 16. The range of movement of rod 48 is protected by a rigid housing 54 which is threadedly engaged with a boss on the outer surface of top cap 40. Housing 54 includes a window 56 through which indicator rod 48 may be viewed.

Bottom cap 42 has a central aperture 58. Prior to installation of the actuator on a valve, (as shown in FIG. 1) a displacement cap 60 is slidingly received in aperture 58. Seals 63 prevent leakage of fluid into or out of chamber 16 via aperture 58. Displacement cap 60 has a large-bore central recess 62 which is open to the front of the actuator. The surface of cap 60 facing piston 12 carries a guide rod 64, the rod being threadedly secured in a central recess in the said face of cap 60. Guide rod 64 extends through chamber 16 and is received in a central bore 66 within indicator rod 48. Upon installation of the actuator on a valve (refer to FIG. 2), a reduced diameter boss 68 at the end of the valve stem 70 is received in recess 62 of cap 60. The valve stem and cap enter chamber 16, with guide rod 64 moving along bore, 66 in rod 48. When fully installed, as shown in FIG. 2, cap 60 is received within recess 26 of piston 12, so as to abut the head 52 of rod 48. During the installation process, seals 63 seal against cap 60 and then against stem 70 in order to ensure that there is no fluid leakage during installation.

The valve bonnet 72 receives the actuator in a latch ring 74. Ring 74 forms an integral part of the bonnet. The valve is provided with a gland 76 which is bolted to bonnet 72 and which carries seals 77, to accommodate sliding movement of stem 70 through the bonnet. Gland 76 is received within the end of barrel 38 and abuts against the bottom cap 42.

Latch ring 74 co-operates with a latch mechanism 78 carried by the actuator in order to releasably secure the actuator to the valve. Latch mechanism 78 comprises a split ring 80 and an activator sleeve 82. Components 80 and 82 are carried on the external surface of housing barrel 38, adjacent a lip 84 which projects radially outwards at the forward face of barrel 38. Activator sleeve 82 slides on the external surface of barrel 38 and is restrained in its rearward movement by a circlip 86 seated in barrel 38. The forward end of activator 82 has a bevelled face 88 which, prior to activation of the latch, mates with a complimentary bevel face 90 on split ring 80. Once the activator has been landed in the latch ring of the valve, activator 82 is driven towards the valve and the bevelled faces 88 and 90 cause split ring 80 to ride up on to the forward end of activator 82. This causes split ring 80 to expand into a complimentary shaped groove 92 formed in the internal surface of latch ring 74. In this position, the flat radially inward face 94 of split ring 80 rests on a correspondingly flat shoulder 96 of activator 82, thus looking the latching mechanism. The free end of activator 82 is profiled so as to receive a tool, for example carried by a Remotely Operated Vehicle ROV, which enables the activator to be withdrawn - in order to unlock the latch.

From the above description, it will be apparent that the actuator is particularly well suited to remote installation and removal in deep sea applications. Sealing of the actuator prior to installation, by use of displacement cap 60, is especially beneficial in subsea applications.

From the position illustrated in FIGS. 1 and 2, pistons 12 and 14 are driven towards the valve, thereby operating the valve via stem 70 and the application of a pressurised operating fluid. The operating fluid is introduced via a port 98 in valve bonnet 72. Port 98 communicates with a port 102 provided in barrel housing 38 via a connector 100, which ensures a fluid tight communication between the ports. Port 102 communicates with chamber 16 via a inlet passage 104 which is behind the rear face of piston 14. In its rearward position, piston 14 abuts ah annular stop 106 projecting from the inner face of cap 40. Thus, the supply of pressurised operating fluid via port 102 and passage 104 causes pistons 12 and 14 to be driven within chamber 16 towards the valve. Any fluid on the forward side of the pistons is forced out of chamber 16 via a port 108 which passes through bottom cap 42 and communicates with an exhaust port 110 provided in the valve bonnet 72.

At the end of the stroke, head 22 of piston 12 mates with a complimentary configuration 112 in barrel 38 of the forward end of chamber 16. A metal-to-metal seal is thus formed. At the beginning of the stroke, forces acting within the valve on stem 70 result in piston 12 holding piston 14 against stop 106. During the forward stroke, the pressure of the operating fluid maintains the contact between the pistons. However, when piston 12 seals against surface 112, a pressure equalisation mechanism comes into operation with the result that spring 34 is able to drive piston 14 rearwards, away from piston 12.

The pressure equalisation mechanism comprises at least one passage 114 which passes through the base plate 30 and the annular ring 28 of secondary piston 14. The rearward face of head 22 of piston 12 includes two radial annular surfaces 116 and 118 which are interconnected by a bevelled surface 120. Ring 28 includes a radial face 122 which corresponds to and mates with surface 116. Face 122 carries a seal 124 which ensures a fluid tight seal between the pistons 12 and 14 at the beginning of and during the stroke of the pistons within cylinder 16. Ring 28 also includes a radial face 126 which corresponds to face 118. Face 126 does not, however, at any time abut against face 118. That is, a small clearance 128 exists between faces 118 and 126 when pistons 12 and 14 are fully in contact with each other.

Passage 114 enables fluid flow from the rear or driving side of the secondary piston 14, through the said clearance 128, thereby enabling the operating fluid to pass through the secondary piston and equalise the pressure on either side thereof. In view of the restricted nature of clearance 128, the pressure equalisation across the secondary piston 14 does not occur to any significant extent until the primary piston 12 has landed on surface 112, at the completion of the stroke. ,However, a second and larger passageway, 130, passes through baseplate 30 and communicates with the space occupied by spring 34. Thus, once pressure equalisation has occurred, via passage 114, to such an extent that piston 14 moves rearwards from piston 12, there is an increased fluid flow across piston 14. That is, faces 116 and 122 move apart and seal 124 is no longer effective. The pistons retain this attitude with respect to each other, that is separated under the action of spring 34, when the operating pressure is removed. Consequently, pistons 12 and 14 are driven backwards in cylinder 16 under the action of forces acting within the valve on stem 70. During this motion, fluid flows through passage 130 and this enables a fast return stroke to be achieved. The need to provide volume compensation is also avoided. It will be appreciated that unlike the conventional arrangement, the above described operation dumps fluid on the power stroke and not on the return stroke. The exchange of fluid between the chamber portions on either side of the pistons during the return stroke is a feature which is believed to be unique.

In the embodiment described above, with reference to FIGS. 1 and 2, provision has been made for a separate pressure equalisation passage 114 and separation of the pistons 12 and 14 under the action of a spring 34. These are design features which are not essential to the inventive concept. For example, passage 114 can be replaced by an arrangement which causes the primary piston to unseat hydraulically at the end of the stroke, by creating a differential area across the secondary piston. Similarly, passage 114 could be replaced by a deliberately designed seal leakage between the pistons.

A further embodiment of the invention will now be described with reference to FIG. 3 of the accompanying drawings.

Figure 3:
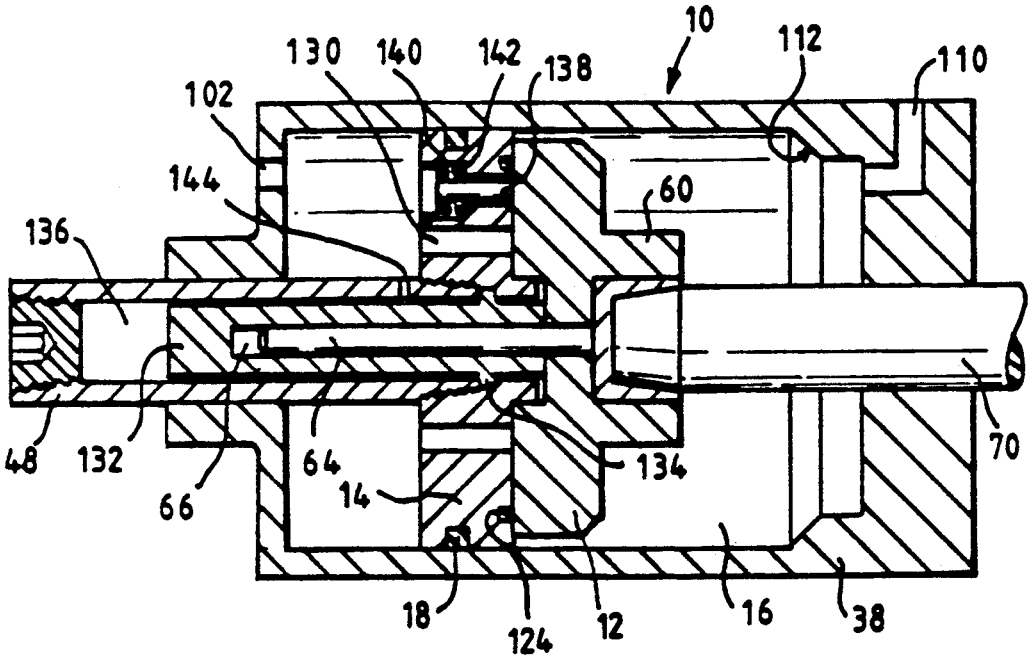
FIG. 3 is a schematic vertical section through a valve actuator, when installed, the actuator including a piston assembly in accordance with a second embodiment of the invention.

FIG. 3 is a somewhat more diagrammatic sketch than FIGS. 1 and 2. However, the same reference numerals have been used to designate components which essentially correspond to those of the previous embodiment, even though the details of the components may differ. Thus, the arrangement comprises a housing 10 formed of a barrel 38 defining a chamber 16 in which a primary piston 12 and a secondary piston 14 reciprocate. Valve stem 70 is received by a displacement cap 60 which is itself received in primary piston 12. The configuration of the primary piston is essentially reversed to that of the previous embodiment. That is, in this case the boss projects forward and the indicator rod 48 is attached to the secondary piston 14 rather than to the primary piston 12. Indicator rod 48 is threadedly secured to secondary piston 14 and primary piston 12 includes a integral guide rod 132 which slides within a bore 136 within indicator rod 48. Guide rod 132 is provided with a central bore 66 within which the guide rod 64 of the displacement cap 60 slides. Fluid tight seals 134 are located between secondary piston 14 and guide rod 132, so as to isolate the bore 136 within which guide rod 132 slides.

In this embodiment, secondary piston 14 comprises essentially a circular plate which is held relative to the primary piston 12 by bolts 138 (of which one is illustrated). The head of the bolt 138 is received within an enlarged recess 140 open to the rear face of piston 14. A spring 142 acts between the head of the bolt 138 and the piston 14. Spring 142 attaches the secondary piston to the primary piston and clamps the pistons together. Fluid flow passages 130 pass through piston 14, but these passages are sealed by the rear face of the piston 12, when pistons 12 and 14 are in contact with each other. As in the previous embodiment, a seal 124 is provided at the interface between the pistons. In the present embodiment, a bleed hole 144 connects the internal bore 136 of indicator 48 with the portion of chamber 16 to the rear of the pistons. This arrangement provides for hydraulic unseating of the secondary piston 14.

At the rest position, as illustrated in FIG. 3, the forces generated internally of the valve and acting on stem 70 cause the primary piston 12 to abut hard against the secondary piston 14. Thus, there is a fluid tight seal separating the two portions of chamber 16. Consequently, when pressurised operating fluid is introduced via port 102, the pistons are driven forward as a single unit. At the end of the stroke, piston 12 lands in the complimentary configuration 112 at the end of chamber 16. As in the previous embodiment, the operating pressure is equalised across the secondary piston 14 once piston 12 has landed. That is, bleed hole 144 effectively enables the operating pressure to be equalised across the secondary piston 14. However, the differential area of the secondary piston subject to the influence of the operating pressure (having regard to the fact that indicator rod 48 passes to the outside of housing 10) is sufficient to cause separation of the pistons. The resulting backward movement of piston 14 is limited by bolt 138 and compression of spring 142.

Upon removal of the operating pressure, the forces acting within the valve drive primary piston 12 rearwards. However, the effective pressure look of operating fluid in bore 136 maintains separation of the primary and secondary piston. As a result, the operating fluid flows freely through passages 130 from rear side of the pistons to the other forward side thereof. Consequently, the same advantages are obtained as in the previous embodiment, with respect to the speed of the return stroke etc.

With the actuator fully stroked there is equal pressure between bore 136 and the secondary piston 14 side of chamber 16. On release of pressure on the secondary piston side of chamber 16 it will take time for the pressure in bore 136 to bleed back through port 144.

As a consequence, there is a larger pressure in bore 136 acting on the area at the end of rod 132 which provides a force to separate pistons 12 and 14, hence opening up a passage between the pistons to allow the transfer of fluid from one side of chamber 16 to the other side during return stroke.

The time it takes for the pressure to bleed back through port 144 determines how long pistons 12 and 14 remain separated.

The bleed hole or port 144 should be large enough to ensure that the pistons separate as quickly as possible at the end of the stroke, but small enough to ensure that the pistons remain separated during the entire return stroke.

As in the previous embodiment, various modifications may be made. For example, bleed hole 144 can be replaced by a deliberately designed seal leakage.

In general, various modifications and alternative embodiments will be readily apparent to those skilled in the art upon reference to the above description and the accompanying drawings. Such modifications and alternative embodiments fall within the scope of the present invention.

What is claimed is:

1. A piston assembly comprising a primary piston and a co-centric secondary piston, both for reciprocating movement within a piston housing, the pistons being capable of reciprocating movement relative to each other and being arranged within the housing for operating pressure to be applied to the secondary piston so as to drive both pistons within the housing, wherein the secondary piston is provided with means enabling the operating pressure to be equalised across the secondary piston and is provided with a by-pass passage therethrough, the by-pass passage is of relatively large bore and the pressure equalisation means comprises a passage of relatively narrow bore extending through the secondary piston, the pistons being held in tight abutment with one another during the forward stroke within the housing so that said by-pass passage is sealed, said by-pass passage becoming operable subsequent to said pressure equalisation.

2. A piston assembly as claimed in claim 1, wherein the secondary piston comprises a baseplate and an annular ring.

3. A piston assembly as claimed in claim 1, wherein the primary piston comprises an enlarged head and a concentric boss projecting therefrom.

4. A piston assembly as claimed in claim 1, wherein the secondary piston is in sliding contact with the housing and the primary piston is carried by the secondary piston.

5. A piston assembly as claimed in claim 3, wherein the boss of the primary piston extends through an aperture in a baseplate of the secondary piston with the pistons being urged apart by resilient biasing means acting between the enlarged head of the primary piston and the baseplate of the secondary piston.

6. A piston assembly as claimed in claim 1, wherein the relatively narrow bore is partially sealed by an enlarged head of the primary piston when the primary and secondary pistons are held in tight abutment.

7. A piston assembly as claimed in claim 3, wherein the means for equalising the operating pressure extends through the baseplate along.

8. A piston assembly as claimed in claim 1, wherein the secondary piston comprises a circular plate with a concentric hollow boss projecting from one face thereof with the periphery of the plate in sliding contact with the housing.

9. A piston assembly as claimed in claim 8, wherein the primary piston comprises a circular plate having an elongate guide rod projecting centrally from one face thereof, the guide rod being received within the boss of the secondary piston.

10. A piston assembly as claimed in claim 9, wherein the pressure equalisation means comprises a bleed hole passing through the boss of the secondary piston so as to allow operating fluid to act on the guide rod of the primary piston.

11. A piston assembly as claimed in claim 8, comprising resilient biasing means carried by the pistons and acting to maintain contact between the pistons.

12. A piston assembly as claimed in claim 8, wherein the pressure equalisation means comprises one or more apertures which extend through the circular plate of the secondary piston.

13. A piston assembly as claimed in claim 1, wherein the housing is provided with means for releasably attaching the housing relative to a stem to be actuated and includes a plug for sealing an aperture to the housing and receiving the stem, the plug being displaced within the housing to enable the pistons to act upon the stem via the plug.

14. A piston assembly as claimed in claim 13, wherein the primary piston contains a central recess for receiving the plug.

15. A piston assembly as claimed in claim 13, wherein the plug is provided with a guide rod which extends through a central aperture provided in the pistons.

16. A piston assembly as claimed in claim 1, wherein the primary piston carries an indicator rod which extends through the housing, thereby providing an indication of the location of the primary piston within the housing.

17. A piston assembly as claimed in claim 15, wherein the guide rod is slidably received in a central bore provided in the indicator rod.

18. A piston assembly as claimed in claim 1, further comprising means in the form of a split ring and an activator sleeve therefor provided on the housing for releasably attaching the housing to another object.

19. A piston assembly as claimed in claim 3, wherein the boss of the primary piston extends through an aperture in a baseplate of the secondary piston with the pistons being urged apart by resilient biasing means acting between the enlarged head of the primary piston and the baseplate of the secondary piston.

20. A piston assembly as claimed in claim 16, wherein the guide rod is slidably received in a central bore provided in the indicator rod.

21. A valve, comprising:

a fluid activated actuator connected to a valve bonnet, the actuator including a primary piston and a co-centric secondary piston, both pistons for reciprocating movement within a piston housing, the valve bonnet accommodating sliding movement of a valve stem coupled to the head of the primary piston, the pistons being capable of reciprocating movement relative to each other and being arranged within the housing for pressurised operating fluid to be applied to the base of the secondary piston so as to drive both pistons within the housing, a by-pass passage having a relatively narrow bore extending through the secondary piston, some of the fluid for being passed through the by-pass passage of the secondary piston during the forward stroke of the pistons for equalising pressure across the secondary piston, a second passage of a relatively large bore being provided between the outer wall of the primary piston and the inner wall of the secondary piston, a biasing means being provided within the second passage, the pistons being held in tight abutment with one another during the forward stroke so that none of the fluid passes through the second passage during the forward stroke, and the pistons being separated from one another by the biasing means after the forward stroke and pressure equalisation so that the second passage becomes operable on the return stroke of the pistons.

* * * * *